United States Patent [19]

de Vries

[11] 4,072,297

[45] Feb. 7, 1978

[54] CONICAL MIXING APPARATUS HAVING SUPPORT STRUCTURE FOR THE MIXING SCREW PROVIDED BELOW THE BOTTOM OF THE MIXING VESSEL

[76] Inventor: Jan Willem de Vries, Vincent van Goghstraat 69, Zelhem, Netherlands

[21] Appl. No.: 758,826

[22] Filed: Jan. 12, 1977

[30] Foreign Application Priority Data

Jan. 21, 1976 Netherlands ..... 7600638

[51] Int. Cl.[2] ..... B01F 7/08

[52] U.S. Cl. ..... 366/287; 366/318

[58] Field of Search ..... 259/111, 27, 47, 95, 259/91, 93, 4 R, 5, 8, DIG. 16

[56] References Cited

U.S. PATENT DOCUMENTS

| | | | |
|---|---|---|---|
| 2,867,997 | 1/1959 | Lake | 259/DIG. 16 |
| 3,315,947 | 4/1967 | Nauta | 259/111 |
| 3,556,487 | 1/1971 | Nauta | 259/111 |

*Primary Examiner*—Edward J. McCarthy

[57] ABSTRACT

Mixing apparatus having a vertical mixing vessel and a mixing screw rotatable therein, the lower end of said screw being supported by bearings and a universal joint. One of the universal joint parts is below the vessel bottom and the other part extends through said bottom. The upper surface of the other part is in the shape of a sphere segment and is sealed in the bottom aperture by a sealing ring.

9 Claims, 3 Drawing Figures

CONICAL MIXING APPARATUS HAVING SUPPORT STRUCTURE FOR THE MIXING SCREW PROVIDED BELOW THE BOTTOM OF THE MIXING VESSEL

BACKGROUND OF THE INVENTION

The invention relates to a mixing apparatus comprising at least one mixing vessel having a side wall and a vertical axis, and comprising in the vessel a mixing screw driven from its upper end by drive mechanism, the mechanism supporting the screw at its upper end for rotation simultaneously around its axis and around the vessel axis. The lower end of the mixing screw shaft is supported in a bearing adjacent to the vessel bottom. The bearing structure includes a universal joint as well as radial and axial force receiving bearings.

Such mixing apparatus is known. A support structure having a universal joint and radial and axial forces receiving bearings are necessary for larger mixing apparatus. This is contrary to smaller mixing apparatus in which the forces are smaller, e.g. as according to the Dutch Pat. No. 110,847 and the Dutch Pat. application 7408885 (laid open for public inspection on Jan. 5, 1976), In a known construction developed by Applicant the lower end of the mixing screw shaft is connected by the universal joint to a short vertical shaft supported in the radial and axial force receiving bearings which are provided in a bearing housing fixedly secured below the mixing vessel bottom. The universal joint is situated above the bottom wall of the vessel and in the material to be mixed. Since the joint carries out a somewhat pumping movement during the operation of the mixing apparatus, the material to be processed may be damaged, dependent on the nature thereof. At the same time the joint wears and worn particles or lubricant matter may contaminate the product.

One could avoid such disadvantages by positioning the vessel bottom over the universal joint. However, this meets with the difficulty of providing sealing between the vessel bottom and the bearing housing due to the pivotal movement of the screw shaft adjacent to the bottom.

The present invention provides, starting from Applicant's earlier construction, a solution whereby the first-mentioned disadvantages are eliminated. A further solution is obtained for the sealing at the bottom while a conpact design of the supporting structure is obtained.

SUMMARY OF INVENTION

These solutions are obtained by the invention in that one of the parts of the universal joint is supported with its pin ends in a housing supporting the mixing apparatus situated below the bottom wall of the mixing vessel and the radial and axial force receiving bearings are mounted in a bearing supported provided perpendicular to the pin of the other part of the universal joint. A cover part is secured over the bearing support around the mixing screw shaft and projects into the mixing vessel through an aperture in the vessel bottom. The cover part has an upper surface shaped as a segment of a sphere around the centre of the universal joint, said sphere segment being sealed with respect to the mixing vessel bottom by mens of an elastic sealing ring.

The capacity of the mixing container is thus increased in that the universal joint has been removed therefrom. On the other hand the mixing vessel may be made shorter maintaining its capacity respectively. Despite the provision of the universal joint below the bottom of the mixing vessel the height of the support housing below the vessel proper has not been increased in that the bearing support has been received in the universal joint. A further advantage is that the supporting force of the mixing screw shaft is received by the shaft exclusively axially whereas in the known design due to the vertical shaft, a radial component is also present.

The sphere segment cover part may be secured to the shaft so that it rotates together with the shaft. However, in order to strongly decrease the wear of the sealing ring it is preferable to secure the cover part having the sphere segment as its upper surface to the bearing support by the pin of the universal. Thus it, at the same time serves to support a stuffing box around the shaft and comprises an open space adjacent to the stuffing box which at the lower wall of the sphere segment communicates with the interior of the housing below the mixing vessel Any material penetrating through the stuffing box in spite of sealing measures thereby arrives in the open space below the sphere segment and drops into the supporting housing. It is thereafter not constrained through narrow slots towards the bearings in the bearing support which would be the case if the bearing support would be directly connected to the stuffing box.

Operation is improved when a slinging plate is secured, extending transversely, to the shaft between the stuffing box and the bearing support.

Material arriving in the housing through the stuffing box or through the sealing ring on the sphere segment collects on the bottom of that housing and may be intermittently discharged by releasing the bottom or a cover therein. Preferably the lower wall of housing of the mixing apparatus is provided with one or more apertures for the material to fall through. The discharge is then automatic and at the same time provides a visible indication of the correct functioning of the seals, namely by the absence of too much material falling through. This measure can also be obtained by the complete omission of a bottom.

As a known measure for improving the sealing, flushing may be applied, as well to the sealing ring on the sphere segment as well as to the stuffing box, by flushing conduits for air, water or a different pressure fluid.

The invention will be hereunder illustrated with reference to the drawing in which an example of an embodiment of the mixing apparatus according to the invention is shown.

DESCRIPTION OF THE INVENTION

Figure 1:
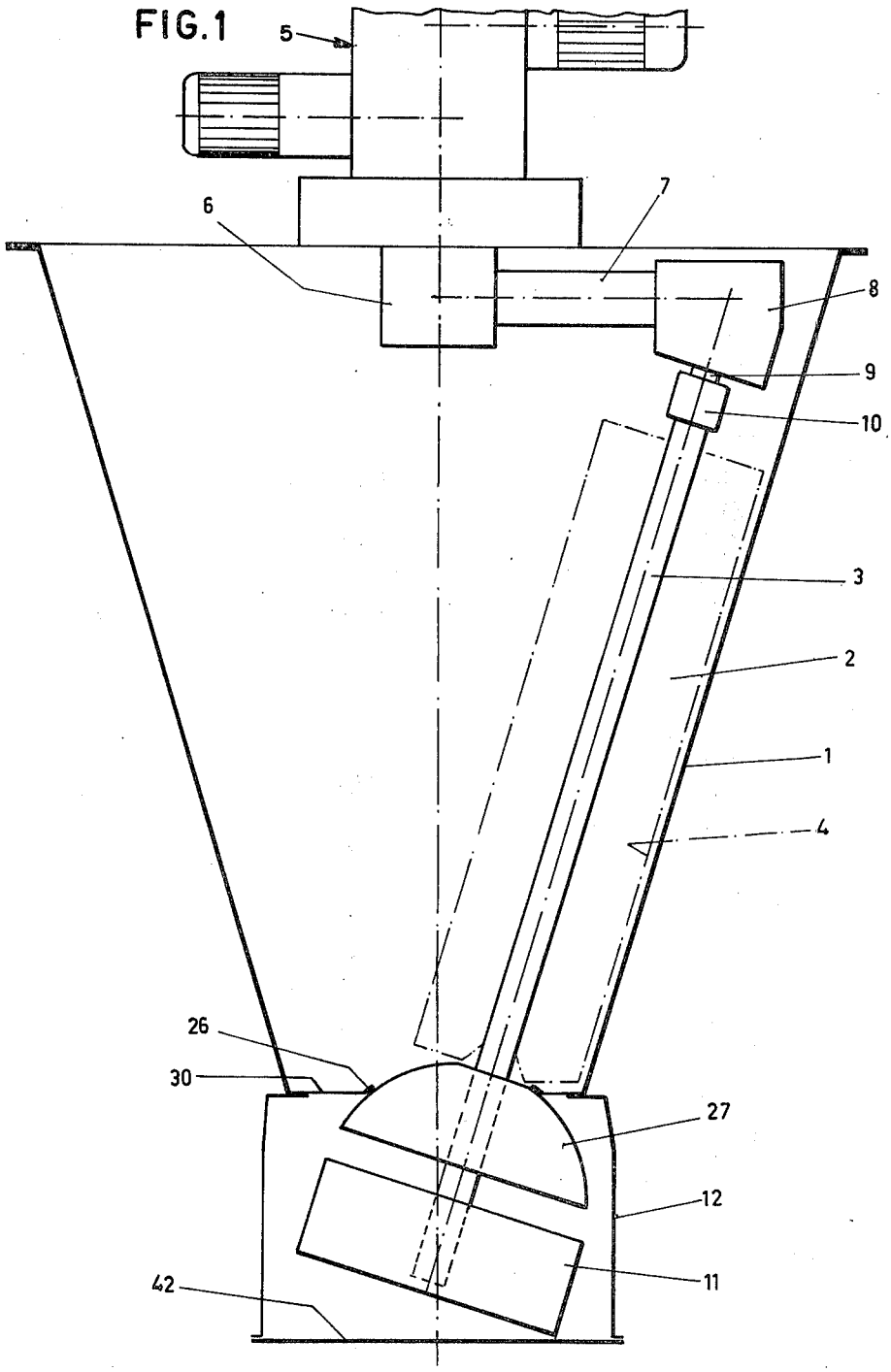
FIG. 1 shows a side view of the mixing apparatus.

The mixing apparatus shown in FIG. 1 has a conical mixing vessel 1 in which a mixing screw 2 is mounted with the mixing screw shaft 3 supported parallel to the generating line of the mixing vessel. The screw blade 4 is schematically indicated by dot and dash lines. The mixing vessel has an upper drive mechanism 5 including a vertical output shaft (not shown) which is connected by bevel gears, likewise not shown, but received in a casing 6, to a swinging arm 7 supported in the casing 6 and with its other end in a transmission head 8. The swinging arm 7 extends radially in the mixing vessel. A second conical transmission is provided within the head 8 whereby the arm 7 is coupled to a shaft 9. The shaft 9 is connected through a claw coupling 10 to the screw shaft 3. The drive mechanism is such that the arm 7 may be driven rotating around the vessel axis and at the same time the screw shaft 3 is rotatable around its own axis.

Figure 2:
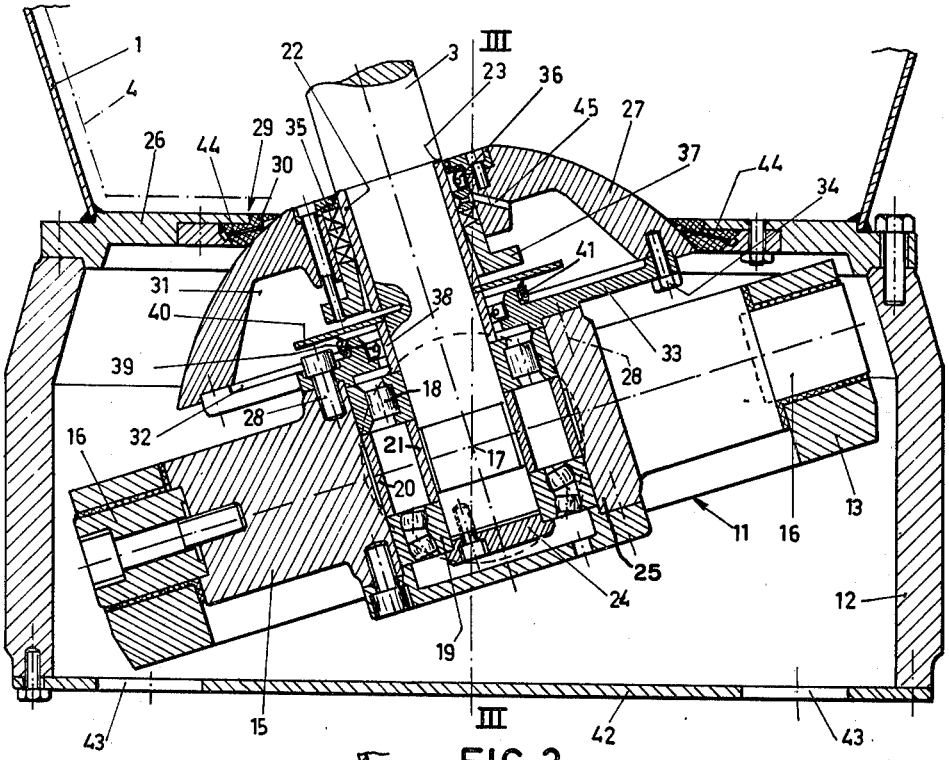
FIG. 2 is an axial longitudinal cross-section through the lower housing part of the mixer.

The lower end of the shaft 3 is supported in a universal joint 11 mounted and received in a housing 12 on which the mixing vessel is also supported. The design details of the bearing structure of the lower end of the shaft 3 are indicated in FIGS. 2 and 3.

Figure 3:
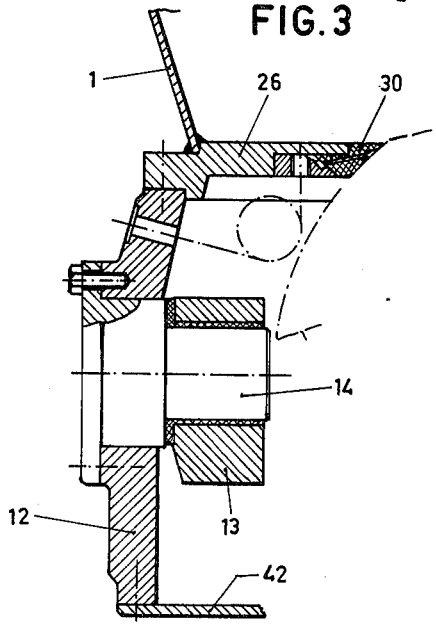
FIG. 3 is a partial cross-section according to a plane along line III — III perpendicular to that of FIG. 2.

The universal joint 11 comprises a first annular or half annular shaped ring 13 which is supported in the wall of the housing 12 by means of horizontal pivot pins 14, one of which is shown in FIG. 3. The pins are diametrally opposed and are secured to the wall of the housing section 12 by bolts. The other ring 15 of the universal joint is supported through two diametrally opposed pivot pins 16 secured in the first ring 13 of the universal joint. The pins 16 are each secured in the embodiment shown through a bolt in the second ring 15 and have a common axis perpendicular to the common axis of the pins 14. The axes intersect in the centre 17 of the joint.

The screw shaft 3 is supported in the second universal joint ring 15 such that its axis likewise intersects the centre 17. The shaft 3 is supported by means of a roller bearing 18 adapted to receive radial and axial forces and by a self-adjustable double row roller bearing 19 at the end of the shaft 3. Spacing sleeves 20, 21 are provided between both bearings, the assembly being retained through a bearing sleeve 22 against a shoulder 23 of the shaft 3 by means of an end plate 24 secured in the shaft end by means of bolts. The bearings 18 and 19 are received in a bearing support 25 located along the axis of the second universal joint ring 15.

The end of the shaft 3 is supported by the described structure that it may carry out the swinging movement through the mixing vessel 1 and the rotation around its own axis by the assembly of the universal joint in the lower housing 12 and by the radial and axial forces receiving bearings 18, 19 in a bearing support 25.

The sealing between the contents of the mixing vessel 1 that is between the bottom 26 of the vessel and the housing 12 is obtained by a spherical segment shaped cover 27 which in this embodiment is secured by bolts 28 on top of the second ring 15 of the universal joint 11 and is supported by the shaft 3 by means of the bearing sleeve 22. The bottom 26 of the vessel has an aperture 29 through which the sphere segment 27 partially extends. An elastic sealing ring 30, e.g. of synthetic material, is mounted in the aperture 29 and engages the spherical surface 27 which has its centre in the centre 17 of the joint.

The sphere segment 27 is hollow defining a space 31 which communicates through one or more apertures 32 in the bottom wall 33 with the interior space of the housing 12 of the mixing apparatus. The bottom 33 is connected on the one hand through bolts 34 to the sphere segment and on the other hand through the bolts 28 to the universal joint ring 15.

In order to seal the space between the sphere segment 27 and the bearing sleeve 22 on the shaft 3 against the passage of material from the mixing vessel a stuffing box 35 is formed between these parts. The stuffing box contains a packing, if necessary complemented by a cup seal 36. The packing is pressed together by a gland 37. Also between the bottom wall 33 of the sphere segment and the shaft 3, or as shown a sleeve 38 around said shaft, a sealing cup 39 has been provided for sealing the bearing housing 25.

Any material from the mixing apparatus that would pass the sealing ring 30 arrives in the large free space in the housing 12 and cannot get jammed between rotating parts. the same applies for material that would penetrate between the packing 35 and the sleeve 22 on the shaft, which material likewise arrives in the housing 12 through the hollow space 31 in the sphere segment and through the apertures 32. In order to prevent the last-mentioned material from arriving in the bearing support 25 through the cup 39 it is preferable to secure to the shaft 3 a slinging plate 40 between the stuffing box 35 and the housing 25. Thereby the material which has passed the stuffing box is kept away from the bearing housing and arrives in the housing 12. As an additional safety measure a sealing ring 41 engaging the slinging plate 40 by means of a lip may be provided between the slinging plate and the bottom 33 of the sphere segment.

Material arriving in the housing 12 collects on the bottom wall 42 thereof. This bottom is releasably secured to the housing 12 through bolts. It is preferable to provide one or more throughgoing apertures 43 in the bottom wall 42 whereby it may be observed whether perhaps more material arrives in the housing 12 than is compatible with correct operating seals, in which case the material falls through the apertures 43 and gives a visible indication for an incorrect operation of the mixing apparatus.

The sealing ring 30 and the packing 35 may be provided in a known manner by means of supply conduits 44 and 45 respectively with air or water flushing to prevent the ingress of material.

I claim:

1. Mixing apparatus comprising at least one mixing vessel mounted on a supporting housing, said mixing vessel having a side wall, a bottom wall having a central aperture and a vertical axis, a mixing screw located in said vessel having a central shaft connected to a dirve and support mechanism at its upper end for simultaneously rotating said screw around the axis of its shaft and revolving said screw around the axis of the vessel, the lower end of the mixing screw shaft extending through said aperture and being supported below said vessel in a bearing located in said housing, said bearing comprising a universal joint as well as radial and axial force receiving bearings, said universal joint having a first tiltable member supported by means of pivot pins extending from said housing and a second tiltable member supported by means of pivot pins extending from said first tiltable member, the radial and axial force receiving bearings being mounted in a bearing support in said second tiltable member perpendicular to the pins thereof, a cover secured over said bearing support and around the mixing screw shaft extending through the aperture in the bottom of the mixing vessel, said cover having its upper surface shaped as a segment of a sphere around the centre of the universal joint and means for sealing the spherical surface of the cover with respect to the aperture in the bottom wall of said mixing vessel.

2. The mixing apparatus according to claim 1, wherein the cover is formed to provide a stuffing box around the shaft and defines an open space below said stuffing box communicating with the interior of the housing below the mixing vessel.

3. The mixing apparatus according to claim 1 wherein said cover and shaft is provided with a packing seal arranged between the cover and the screw shaft to form the stuffing box.

4. The mixing apparatus according to claim 2, including a slinging plate secured in a transverse plane to the screw shaft between the stuffing box and the bearing support.

5. The mixing apparatus according to claim 1, wherein the housing is provided with a bottom wall having one or more apertures for the material to drop therethrough.

6. The mixing apparatus according to claim 5 wherein said bottom wall is removable.

7. The mixing apparatus according to claim 2 including means for applying a pressurized fluid to at least one of said sealmeans and said stuffing box.

8. The mixing apparatus according to claim 1, wherein said elastic seal means comprises an elastic seal ring secured to the periphery of the aperture in the bottom wall of said vessel.

9. The mixing apparatus according to claim 1, wherein said vessel is conical and said drive mechanism for said screw revolves said screw in a conical path parallel to the wall thereof.

* * * * *